US007823702B2

(12) United States Patent
Hirade

(10) Patent No.: US 7,823,702 B2
(45) Date of Patent: Nov. 2, 2010

(54) ELEVATOR MONITORING SYSTEM INCLUDING AUTOMATIC PASSENGER DETECTION

(75) Inventor: Masaaki Hirade, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 592 days.

(21) Appl. No.: 11/817,516

(22) PCT Filed: Dec. 5, 2005

(86) PCT No.: PCT/JP2005/022275

§ 371 (c)(1),
(2), (4) Date: Aug. 31, 2007

(87) PCT Pub. No.: WO2007/066376

PCT Pub. Date: Jun. 14, 2007

(65) Prior Publication Data

US 2008/0123826 A1 May 29, 2008

(51) Int. Cl.
*B66B 1/34* (2006.01)

(52) U.S. Cl. ..... 187/392; 187/382; 187/247; 187/901

(58) Field of Classification Search ..... 187/247, 187/391–393, 380–388, 901
See application file for complete search history.

(56) References Cited

U.S. PATENT DOCUMENTS 4,299,309 A * 11/1981 Bittar et al. ..... 187/392
5,386,463 A * 1/1995 Thompson ..... 379/182
6,263,069 B1 * 7/2001 Schulze ..... 379/352
6,967,580 B1 * 11/2005 Schulze ..... 340/573.7
7,428,002 B2 * 9/2008 Monroe ..... 348/143

FOREIGN PATENT DOCUMENTS

| | | | |
|---|---|---|---|
| JP | 62-255378 | | 11/1987 |
| JP | 1-94364 | | 6/1989 |
| JP | 03177278 | A * | 8/1991 |
| JP | 03238272 | A * | 10/1991 |
| JP | 04125283 | A * | 4/1992 |
| JP | 05262463 | A * | 10/1993 |
| JP | 7-33353 | | 2/1995 |
| JP | 7-172726 | | 7/1995 |
| JP | 2004-015110 | | 1/2004 |
| JP | 2007331849 | A * | 12/2007 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an elevator monitoring system, an operation monitoring apparatus receives operation condition data from a group supervisory control device so as to display operation conditions of elevators on a monitor. The operation monitoring apparatus and the interphone base device can telephone-communicate with each other. The operation monitoring apparatus detects that a passenger within a car of at least one of the elevators cannot perform an interphone communication based upon the operation condition data and information of communication conditions with respect to the interphone terminal devices, which are received from the interphone base device.

7 Claims, 11 Drawing Sheets

FIG. 6

| ITEM | DETECTION INFORMATION | DISPLAY INFORMATION |
|---|---|---|
| UNDETECTED TIME INFORMATION | FROM ZERO SECOND | EQUAL TO OR LONGER THAN 180 SECONDS |
| CAR LOAD INFORMATION | 0～100% | EXCEED 0 %<br>(PASSENGER IS PRESENT) |
| DISASTER OPERATION INFORMATION | · TURN ON FIRE SUPERVISORY OPERATION FLAG<br>· TURN ON EARTHQUAKE SUPERVISORY OPERATION FLAG<br>· TURN ON OTHER DISASTER-TIME OPERATION FLAGS | DETECT ANY ONE OF LEFT-DESCRIBED ITEMS |

FIG. 7

| ITEM | DETECTION INFORMATION | EVALUATION VALUE CALCULATING METHOD | EVALUATION COEFFICIENT |
|---|---|---|---|
| UNDETECTED TIME INFORMATION | FROM ZERO SECOND | UNDETECTED/180 | $\alpha$ (EXAMPLE:1) |
| CAR LOAD INFORMATION | 0～100% | 1 | $\beta$ (EXAMPLE:1) |
| DISASTER OPERATION INFORMATION | · TURN ON FIRE SUPERVISORY OPERATION FLAG<br>· TURN ON EARTHQUAKE SUPERVISORY OPERATION FLAG<br>· TURN ON OTHER DISASTER-TIME OPERATION FLAGS | WHEN ANY ONE OF LEFT-DESCRIBED ITEMS IS DETECTED, "1"; OTHER CASES, "0" | $\gamma$ (EXAMPLE:1) |
| PHYSICALLY HANDICAPPED PERSON OPERATION INFORMATION | · TURN ON WHEEL CHAIR OPERATION FLAG<br>· TURN ON OTHER OPERATION FLAGS TO COPE WITH PHYSICALLY HANDICAPPED PERSON | WHEN ANY ONE OF LEFT-DESCRIBED ITEMS IS DETECTED, "1"; OTHER CASES, "0" | $\delta$ (EXAMPLE:1) |

FIG. 8

| ITEM | DETECTION INFORMATION OF ELEVATOR MACHINE A | DETECTION INFORMATION OF ELEVATOR MACHINE B | DETECTION INFORMATION OF ELEVATOR MACHINE C |
|---|---|---|---|
| UNDETECTED TIME INFORMATION | 360 SECONDS | 360 SECONDS | 180 SECONDS |
| CAR LOAD INFORMATION | 5% | 1% | 20% |
| DISASTER OPERATION INFORMATION | FIRE SUPERVISORY OPERATION | FIRE SUPERVISORY OPERATION | FIRE SUPERVISORY OPERATION |
| PHYSICALLY HANDICAPPED PERSON OPERATION INFORMATION | UNDETECTED | WHEEL CHAIR OPERATION | UNDETECTED |

FIG. 9

| ITEM | DETECTION INFORMATION OF ELEVATOR MACHINE A | DETECTION INFORMATION OF ELEVATOR MACHINE B | DETECTION INFORMATION OF ELEVATOR MACHINE C |
|---|---|---|---|
| UNDETECTED TIME INFORMATION | 2 | 2 | 1 |
| CAR LOAD INFORMATION | 1 | 1 | 1 |
| DISASTER OPERATION INFORMATION | 1 | 1 | 1 |
| PHYSICALLY HANDICAPPED PERSON OPERATION INFORMATION | 0 | 1 | 0 |

FIG. 10

| DISPLAY ITEM | DISPLAY CONTENT | DISPLAY EXAMPLE |
|---|---|---|
| INTERPHONE CONDITION | INTERPHONE CONDITION | WAITING |
| ELEVATOR MACHINE NUMBER | ELEVATOR MACHINE NAME | ELEVATOR MACHINE B |
| UNDETECTED | UNDETECTED TIME INFORMATION | 360 SECONDS |
| CAR LOAD | CAR LOAD INFORMATION | 5% |
| CONDITION 1 | DISASTER OPERATION INFORMATION | FIRE |
| CONDITION 2 | PHYSICALLY HANDICAPPED PERSON OPERATION INFORMATION | WHEEL CHAIR |

FIG. 11

| DISPLAY ORDER | ELEVATOR MACHINE NUMBER | OVERALL EVALUATION VALUE |
|---|---|---|
| 1 | ELEVATOR MACHINE B | 5 |
| 2 | ELEVATOR MACHINE A | 4 |
| 3 | ELEVATOR MACHINE C | 3 |

ELEVATOR MONITORING SYSTEM INCLUDING AUTOMATIC PASSENGER DETECTION

TECHNICAL FIELD

The present invention relates to an elevator monitoring system for monitoring operation conditions of elevators by way of displays on a monitor.

BACKGROUND ART

In conventional elevator monitoring apparatuses, operation condition data are received from group supervisory control devices which control operations of cars of a plurality of elevators so as to display the operation conditions on monitors (refer to, for example, Patent Document 1).

Patent Document 1: JP-A-2004-189358

DISCLOSURE OF THE INVENTION

Problems to be Solved by the Invention

In the above-mentioned conventional elevator monitoring apparatuses, since the elevator monitoring apparatuses are not interconnected with interphone apparatuses, in case of emergencies when disaster or the like occurs, it was impossible to detect that interphone communications are not available in a case where, for instance, a passenger in a car falls into a coma.

The present invention has been made to solve the above-mentioned problem, and therefore, has an object to obtain an elevator monitoring system capable of automatically detecting a passenger in a car with which interphone communications cannot be carried out.

Means for Solving the Problem

An elevator monitoring system according to the present invention includes: an interphone base device capable of telephone-communicating with a plurality of interphone terminal devices; and an operation monitoring apparatus for receiving operation condition data from a group supervisory control device which controls operations of a plurality of elevators so as to display operation conditions of the elevators on a monitor, in which: the interphone base device and the operation monitoring apparatus can telephone-communicate with each other; and the operation monitoring apparatus detects that a passenger within a car of at least one of the elevators cannot perform an interphone communication based upon the operation condition data and information of communication conditions with respect to the interphone terminal devices, which are received from the interphone base device.

BRIEF DESCRIPTION OF THE DRAWINGS

FIG. 6 is an explanatory diagram for explaining an example of display conditions of warning information in the warning information detecting means of FIG. 1.

FIG. 7 is an explanatory diagram for explaining calculation criteria of overall evaluation values acquired by the warning information detecting means of FIG. 1.

FIG. 8 is an explanatory diagram for explaining an example of detection information for respective cars of FIG. 1.

FIG. 9 is an explanatory diagram for explaining evaluation values of respective items corresponding to the detection information of FIG. 8.

FIG. 10 is an explanatory diagram for explaining display contents of the respective cars, which are displayed in a warning information display area of FIG. 2.

FIG. 11 is an explanatory diagram for explaining an example of display order information of the warning information displayed in the warning information display area of FIG. 2.

BEST MODE FOR CARRYING OUT THE INVENTION

Figure 1:
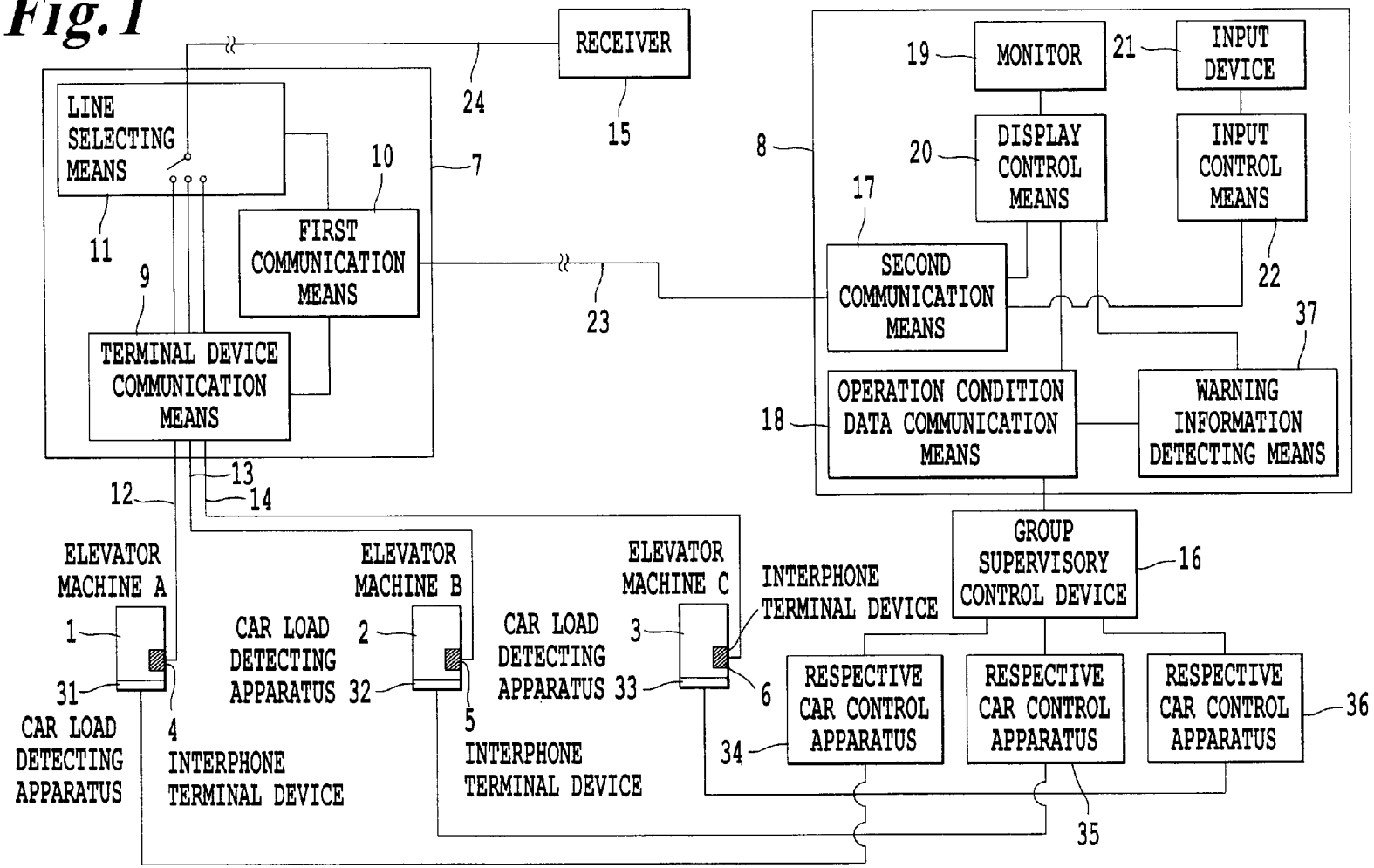
FIG. 1 is a block diagram for showing an elevator monitoring system according to Embodiment 1 of the present invention.

Referring now to the drawings, a preferred embodiment of the present invention will be described.

Embodiment 1

FIG. 1 is a block diagram for representing an elevator monitoring system according to Embodiment 1 of the present invention. This example shows a monitoring system which monitors three elevator machines including elevator machines "A" to "C". Interphone terminal devices 4 to 6 provided in cars 1 to 3 of the respective elevators are used in order that passengers in the cars 1 to 3 perform telephone communications with a manager of a managing room. Receivers (not shown) are provided in the respective interphone terminal devices 4 to 6.

Further, car load detecting apparatuses 31 to 33 which output signals in response to loads on the cars 1 to 3 are installed in the cars 1 to 3.

The managing room corresponds to, for example, a disaster protection center located in a building. Both an interphone base device 7 and an operation monitoring apparatus 8 for monitoring operation conditions of the elevators are installed in the managing room.

The interphone base device 7 includes terminal device communication means 9, first communication means 10, and line selecting means 11. The terminal device communication means 9 is used for communicating with the interphone terminal devices 4 to 6. The first communication means 10 is used for communicating with the operation monitoring apparatus 8. The line selecting means 11 is used for selecting a telephone communication counter party from the interphone terminal devices 4 to 6.

The terminal device communication means 9 is connected via voice cables 12 to 14 to the interphone terminal devices 4 to 6. The terminal device communication means 9 inputs information related to communication conditions of the interphone terminal devices 4 to 6 into the first communication means 10.

Concretely speaking, the terminal device communication means 9 monitors communication conditions of the voice cables 12 to 14 in a periodic manner so as to convert the communication conditions into communication symbols. For instance, a communication symbol as to such a condition (under telephone communication) that telephone communications are established between the interphone terminal devices 4 to 6, and the interphone base device 7 has been set to "1". Also, in such a condition (under calling operation) that the interphone terminal devices 4 to 6 notify a message indicating to the interphone base device 7 that the interphone terminal devices 4 to 6 want to establish telephone communications therewith, a communication symbol has been set to "2". Further, a communication symbol as to such a condition (under waiting condition) that the interphone terminal devices 4 to 6 and the interphone base device 7 are neither under telephone communication nor under calling operation has been set to "3".

For instance, in the case where the interphone terminal device 4 is under calling operation, and both the interphone terminal devices 5 and 6 are under waiting conditions, communication condition information is given as "233". That is, the communication symbols corresponding to the communication conditions are put in the order of the elevator machine "A", the elevator machine "B", and the elevator machine "C". A common conversion table has been set to the terminal device communication means 9, the line selecting means 11, the display control means 20, and the input control means 22.

The first communication means 10 transmits information related to the communication conditions of the interphone terminal devices 4 to 6 to the operation monitoring apparatus 8. Also, the first communication means 10 receives channel selection information used to select a telephone communication counter party from the operation monitoring apparatus 8, and then, inputs the received channel selection information to the line selecting means 11. A receiver 15 is connected via both the line selecting means 11 and a voice cable 24 to the terminal device communication means 9. The receiver 15 is installed in a position where the manager can perform a telephone communication while operating and monitoring the operation monitoring apparatus 8.

The operation monitoring apparatus 8 is connected to a group supervisory control device 16 which controls operations of the cars 1 to 3. The group supervisory control device 16 is connected to respective car control apparatuses 34 to 36 which separately control the corresponding elevators. The group supervisory control device 16 and the respective car control apparatuses 34 to 36 are installed in, for example, a machine room of a building. The operation monitoring apparatus 8 receives operation condition data of the cars 1 to 3 from the group supervisory control device 16. The operation condition data contains, for instance, floor information (car positional information), door open/close information, drive direction information, elevator machine name information, car load information, disaster operation information, physically handicapped person operation information, and the like.

The operation monitoring apparatus 8 includes second communication means 17, operations condition data communication means 18, a monitor 19, display control means 20, an input device 21, input control means 22, and warning information detecting means 37. The second communication means 17 is used for communicating with the first communication means 10. The operation condition data communication means 18 is used for communicating with the group supervisory control device 16. The monitor 19 is used to display thereon operation conditions of the cars 1 to 3. The display control means 20 controls the monitor 19. The input device 21 is used to input operation by the manager. The input control means 22 is operated in response to operation of the input device 21. The warning information detecting means 37 detects warning information from the operation condition data.

The first communication means 10 is connected via a communication cable 23 to the second communication means 17. As the communication cable 23, such a cable is used which satisfies the specification of Ethernet (registered trademark), namely, the specification related to a LAN (Local Area Network) standardized by the IEEE 802.3 committee.

The operation monitoring apparatus 8 includes a computer (not shown) equipped with a calculation processing unit (CPU), a storage unit (ROM, RAM, hard disk etc.), and a signal input/output unit. The functions of the display control means 20, the input control means 22, and the warning information detecting means 37 are realized by the computer in the operation monitoring apparatus 8. In other words, such a program capable of realizing the functions of the display control means 20, the input control means 22, and the warning information detecting means 37 has been stored in the storage unit of the computer. As the input device 21, a mouse and a keyboard may be used which are connected to the computer.

The second communication means 17 receives information related to the communication conditions of the interphone terminal device 4 to 6 from the first communication means 10, and then, inputs the received information into the display control means 20. That is to say, the second communication means 17 writes communication condition information to a first buffer (not shown) of the display control means 20. Then, the display control means 20 displays communication conditions of the interphone terminal devices 4 to 6 on the monitor 19 based upon the communication condition information.

The operation condition data received by the operation condition data communication means 18 is inputted to the display condition means 20. In other words, the operation condition data communication means 18 writes the operation condition data into a second buffer (not shown) of the display control means 20. Then, the display control means 20 controls the monitor 19 to display operation conditions of the cars 1 to 3 based upon the operation condition data.

The warning information detected by the warning information detecting means 37 is inputted to the display control means 20. In other words, the warning information detecting means 37 writes warning information into a third buffer (not shown) of the display control means 20. Then, the display control means 20 controls the monitor 19 to display conditions of the cars 1 to 3 based upon the warning information. As the monitor 19, for instance, a liquid crystal display, a CRT display, a plasma display, and the like may be used.

In response to operation of the input device 21, the input control means 22 inputs channel selection information into the second communication means 17, while the channel selection information is used to select a telephone communication counter party of the interphone base device 7. The channel information is transmitted from the second communication means 17 to the first communication means 10.

Figure 2:
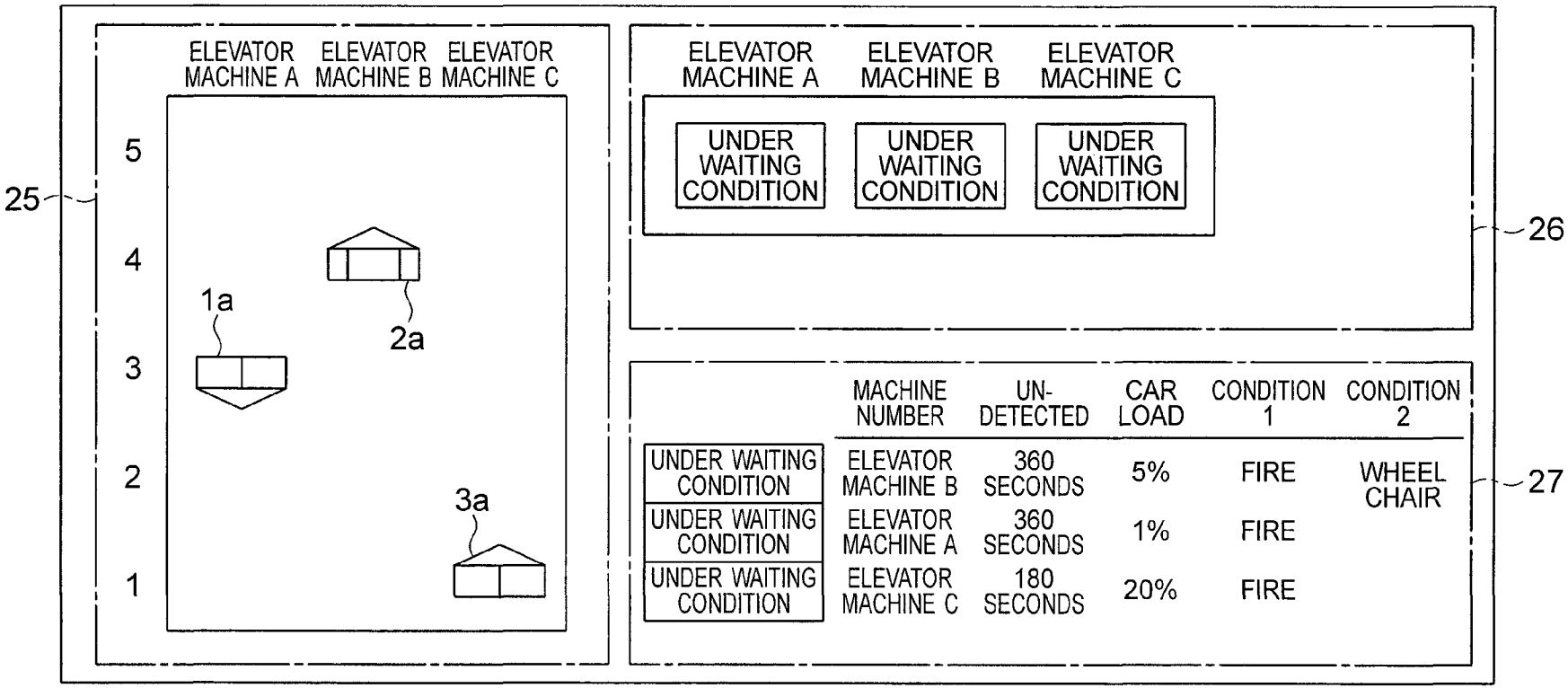
FIG. 2 is a front view for indicating an example of a display content of a monitor of FIG. 1.

FIG. 2 is a front view for indicating an example of a display content of the monitor 19 of FIG. 1. A screen of the monitor 19 includes an operation condition display area 25, a channel selection button display area 26, and a warning information display area 27. The operation condition display area 25 displays thereon information based upon the operation condition data transmitted from the group supervisory control device 16. The channel selection button display area 26 displays thereon information based upon the communication condition information transmitted from the terminal device communication means 9. The warning information display area 27 displays thereon a warning in response to an execution condition of a disaster operation, passenger conditions within the cars 1 to 3, and the like. The operation condition display area 25 displays thereon car indication marks 1*a* to 3*a* which correspond to elevator machine names (elevator machine "A" to elevator machine "C"), floor names (first floor to fifth floor), and the cars 1 to 3.

The car indication marks 1*a* to 3*a* move in response to raising/lowering of the cars 1 to 3. FIG. 2 represents that the car 1 is positioned on the third floor; the car 2 is positioned on the fourth floor; and the car 3 is positioned on the first floor. Also, triangles (direction indicating portions) indicative of directions along which the corresponding cars 1 to 3 are directed have been attached to either upper portions or lower positions of the car indication marks 1*a* to 3*a*. FIG. 2 shows that the car 1 is traveling downward, whereas the cars 2 and 3 are traveling upward. Further, the car indication marks 1*a* to 3*a* indicate open/close conditions of doors of the corresponding cars 1 to 3. FIG. 2 shows that the cars 1 and 3 are under door close conditions, whereas the car 2 is under door open condition.

In the channel selection button display area 26, a plurality of channel selection buttons 4*a* to 6*a* corresponding to the interphone terminal devices 4 to 6, and the elevator machine names corresponding to the channel selection buttons 4*a* to 6*a* are displayed. In the channel selection buttons 4*a* to 6*a*, communication conditions of the corresponding interphone terminal devices 4 to 6 are displayed in response to the communication condition information transmitted from the terminal device communication means 9. Concretely speaking, based upon the conversion table, if the communication symbol is "1", the communication condition of "under telephone communication" is displayed; if the communication symbol is "2", the communication condition of "under calling operation" is displayed; and if the communication symbol is "3", the communication condition of "under waiting condition" is displayed. In FIG. 2, since the communication condition information is "333", the communication condition of "under waiting condition" is displayed on all of the channel selection buttons 4*a* to 6*a*.

The manager in the managing room can input channel selection information for designating any one of the channel selection buttons 4*a* to 6*a* into the input control means 22 by using the input device 21 such as a mouse and a keyboard.

In the warning information display area 27, the elevator machine names, the communication conditions of the interphone terminal devices 4 to 6, and the passenger conditions of the cars 1 to 3 are displayed. Also, a plurality of pieces of the warning information have been arranged to be displayed in the order of an elevator machine having a higher emergency degree from the top portion.

Figure 3:
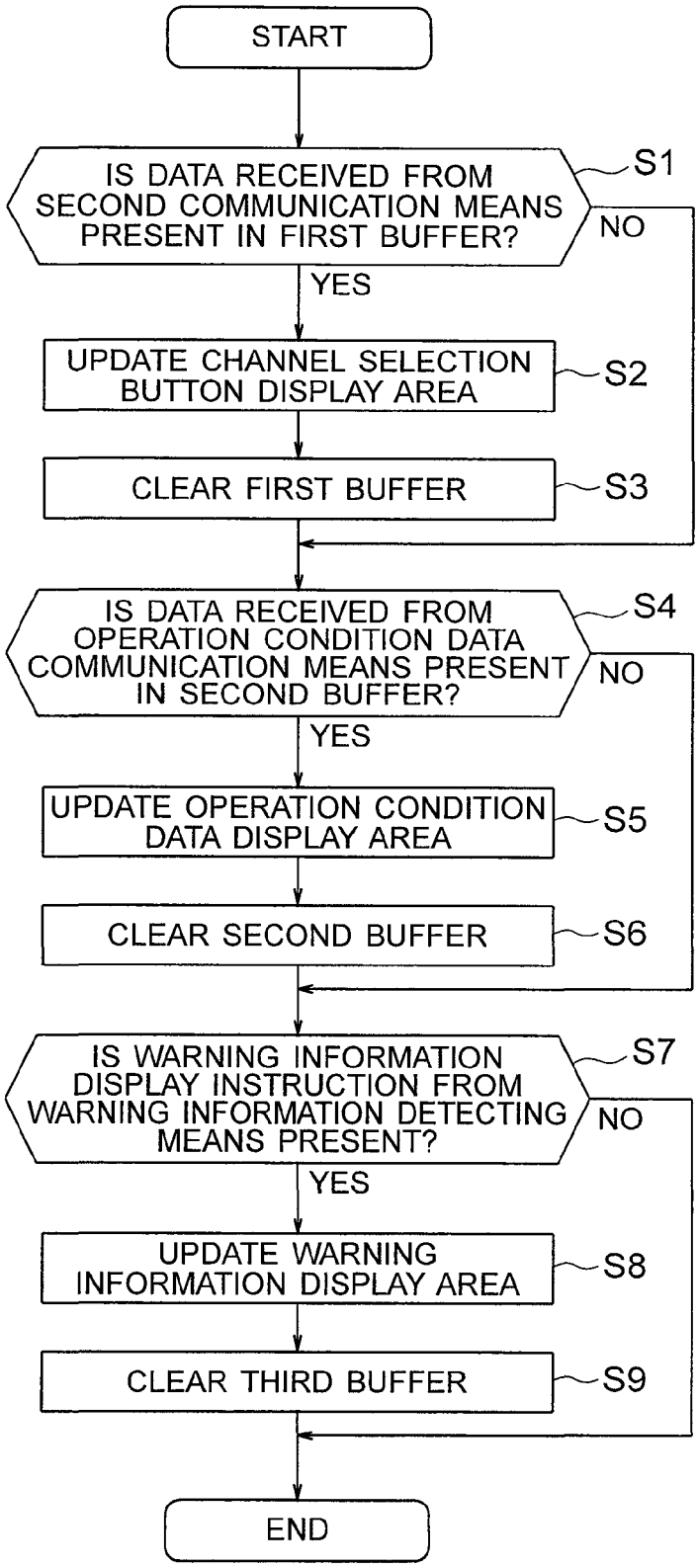
FIG. 3 is a flow chart for describing operations of display control means of FIG. 1.

FIG. 3 is a flow chart for describing operations of the display control means 20 of FIG. 1. The display control means 20 executes a process indicated in FIG. 3 in a periodic manner (for example, every 200 milliseconds), and updates a display content of the monitor 19 as shown in FIG. 2.

In the operation indicated in FIG. 3, firstly, the display control means 20 confirms whether or not data received from the second communication means 17 is present in the first buffer (step S1). When the received data is not stored in the first buffer, the display control means 20 confirms whether or not data received from the operation condition data communication means 18 is present in the second buffer (step S4). If the received data is not stored in the second buffer, then the display control means 20 confirms whether or not data received from the warning information detecting means 37 is present in the third buffer (step S7). If the received data is not stored in any of the first to third buffers, then the process operation is ended.

In the case where the data have been written in the first buffer, the display control means 20 updates the display content of the channel selection button display area 26 (step S2). For example, when a communication condition information of "233" has been written in the first buffer, the display control means 20 recognizes that the communication symbol of the elevator machine A is "2", and the communication symbols of the elevator machines "B" and "C" are "3", and then, displays the display contents of the channel selection button display area 26 as follows based upon the conversion table: namely, the elevator machine A is "under calling operation"; the elevator machine B is "under waiting condition"; and the elevator machine C is "under waiting condition". When the display contents are updated, the display control means 20 initializes the first buffer (step S3), and confirms whether or not the received data is present in the second buffer (step S4).

In the case where the data has been written in the second buffer, the display control means 20 updates the display contents of the operation condition display area 25 (step S5), and then, initializes the second buffer (step S6). Next, the display control means 20 confirms whether or not the received data is present in the third buffer (step S7). In the case where the data (warning information display instruction) has been written in the third buffer, the display control means 20 updates the display contents of the warning information display areas 27 (step S8), and then, initializes the third buffer (step S9). Thereafter, the process operation is ended.

Figure 4:
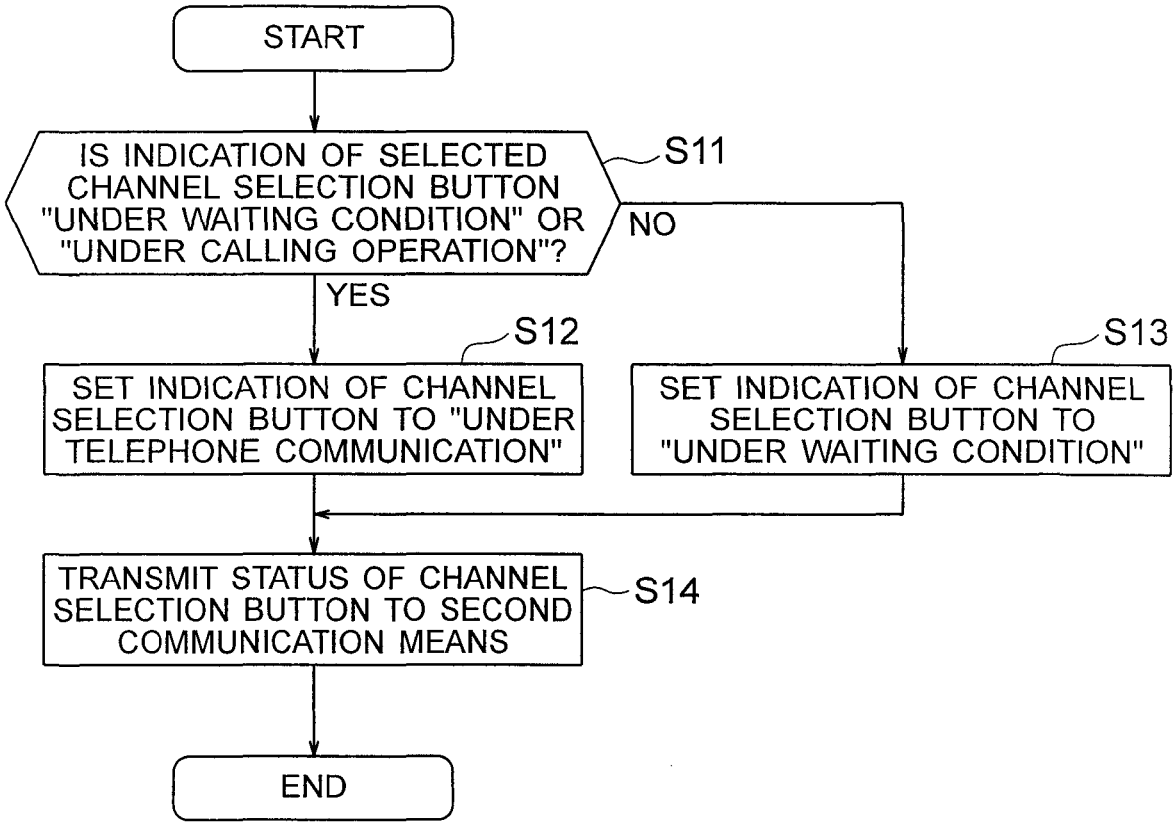
FIG. 4 is a flow chart for describing operations of input control means of FIG. 1.

FIG. 4 is a flow chart for indicating operations of the input control means 22 of FIG. 1. This process flow is commenced by being triggered by the selection of any one of the channel selection buttons 4*a* to 6*a* by using the input device 21. When any one of the channel selection buttons 4*a* to 6*a* is selected, the input control means 22 judges whether the indication of the selected button of the channel selection buttons 4*a* to 6*a* is "under waiting condition", or "under calling operation" (step S11).

In a case where the indication of the selected button of the channel selection buttons 4*a* to 6*a* is "under waiting condition", or "under calling operation", the input control means 22 judges that the manager wants to start a telephone communication with a passenger, and then, changes the indication of the channel selection buttons 4*a* to 6*a* into "under telephone communication" (step S12). Also, in the case where the indication of the selected button of the channel selection buttons 4*a* to 6*a* is "under telephone communication", the input control means 22 judges that the manager wants to end the telephone communication with the passenger, and then, changes the indication of the channel selection buttons 4*a* to 6*a* into "under waiting condition" (step S13).

Thereafter, the input control means 22 transmits the display contents of the channel selection buttons 4*a* to 6*a* after being changed to the second communication means 17 as channel selection information (step S14). The channel selection information is created based upon the conversion table shown in FIG. 2. For instance, if the channel selection conditions of the elevator machine A and the elevator machine C are "under waiting conditions", and the channel selection condition of the elevator machine B is "under telephone communication", then the channel selection information becomes "313" by employing the communication symbols.

When the second communication means 17 receives the channel selection information from the input control means 22, the second communication means 17 immediately transmits the received channel selection information to the first communication means 10. The first communication means 10 inputs the received channel selection information to the line selection means 11. The line selecting means 11 turns ON/OFF the line connections between the receiver 15 and the interphone terminal devices 4 to 6 according to the input channel selection information.

For instance, when the channel selection information is "313", the line selecting means 11 judges that the communication symbol indicative of "under telephone communication" has been allocated to the elevator machine B, and performs a connecting operation between the voice cable 13 which is connected to the interphone terminal device 5 of the elevator machine B, and the voice cable 24 which is connected to the receiver 15. As a result, the passenger in the car 2 of the elevator machine B can perform a telephone communication with the manager in the managing room.

Next, a description is made of display sequence as to the warning information. The respective car control apparatuses 34 to 36 calculate a ratio (car load) of a detected weight with respect to a maximum movable load based upon information from car load detecting apparatuses 31 to 33 in percentage. The information as to the calculated car loads is transmitted via the group supervisory control device 16 to the operation condition data communication means 18. Also, various sorts of information (information indicating a state under operation of wheel chair and the like) detected by the respective car control apparatuses 34 to 36 are transmitted to the warning information detecting means 37 in a similar sequence as with the car load information.

Figure 5:
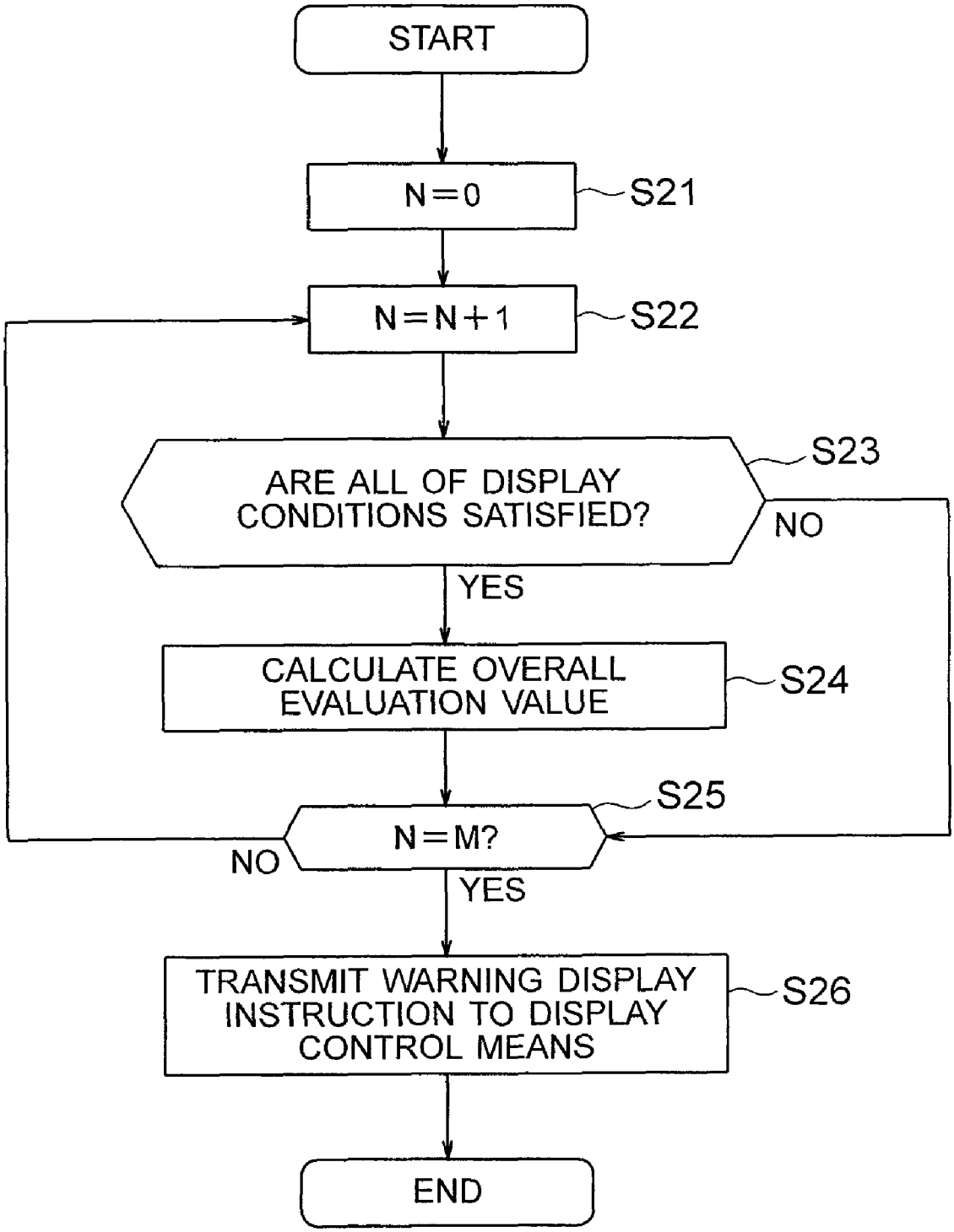
FIG. 5 is a flow chart for describing operations of warning information detecting means of FIG. 1.

FIG. 5 is a flow chart for describing operations of the warning information detecting means 37 of FIG. 1. The warning information detecting means 37 executes the process shown in FIG. 5 in a periodic manner (for instance, every 1 second). When the process is commenced, the warning information detecting means 37 firstly sets a car number "N" of the car to be evaluated to zero, (step S21). Next, the warning information detecting means 37 sets "N" to "N+1" (step S22). Then, the warning information detecting means 37 judges whether or not the car which is presently selected as the evaluation subject car satisfies all of the display conditions for displaying the warning information (step S23). When the car satisfies all of the display conditions, the warning information detecting means 37 calculates overall evaluation of emergency degrees (step S24).

When the display conditions are not satisfied and when the calculation of the overall evaluation is ended, the warning information detecting means 37 confirms whether or not a car which is presently selected as the evaluation subject car corresponds to an Mth (symbol "M" indicates installed number of cars) car (step S25). In other words, the warning information detecting means 37 confirms whether or not the evaluation of the warning information as to all of the cars is ended. If a car which should be evaluated is left, then the warning information detecting means 37 sets "N" to "N+1", and investigates the display conditions for the next car. In the case where N=M, the warning information detecting means 37 creates a warning information display instruction based upon a result of the overall evaluation calculations, and sends the created warning information display instruction to the display control means 20 (step S26).

FIG. 6 is an explanatory diagram for indicating an example of the display conditions in the warning information detecting means 37 of FIG. 1. The warning information detecting means 37 executes overall evaluation of emergency degrees to output a warning information display instruction when all of the display conditions of FIG. 6 are satisfied.

In FIG. 6, ON/OFF conditions of a flag of disaster operation information are given as follows:

ON condition: Disaster supervisory operation is detected.

OFF condition: When any one of the below-mentioned items (1) to (3) is satisfied:

(1) When the detection information of the car load information becomes 0% (namely, when there is no passenger in relevant car);

(2) when the communication condition of the interphone terminal device of the relevant car is "under telephone communication" (when telephone communication is performed for relevant car): and (3) when the communication condition of the interphone terminal device of the relevant car is "under calling operation" (when intention of telephone communication is issued from relevant car).

Count starting/ending conditions for undetected time information are given as follows:

Count starting condition: When the display conditions for both the car load information and the disaster operation information are satisfied (when passenger is present in relevant car, and disaster supervisory operation is started).

Count ending (reset to zero second) condition: In the case where any one of the above-mentioned items (1) to (3) is satisfied.

In other words, when the below-mentioned operation is performed, all of the display conditions are satisfied. That is, although the disaster operation is commenced under such a condition that there is a passenger in a car, such a condition occurs that the passenger does not get off the car for a time period equal to or longer than a preset time (180 seconds in FIG. 6), and further, neither a telephone call from an interphone terminal device nor a telephone communication from the interphone base device 7 is performed.

It should be noted that the display conditions of the undetected time information may be properly set, for example, may be set as 60 minutes.

Also, since the display conditions of the car load information are satisfied by merely detecting whether any passenger is present or not, for example, 3% may be defined as a threshold value by considering a detection error.

Further, as the car load detecting apparatus, any types of detecting apparatuses may be applied, and such a type of detecting apparatus which is not directly mounted on a car may be used.

Next, a description is made of a method for calculating overall evaluation values. FIG. 7 is an explanatory diagram for explaining calculation criteria of the overall evaluation values calculated by the warning information detecting means 37 of FIG. 1. In this case, ON/OFF conditions of a flag of physically handicapped person operation information are given as follows:

ON condition: In the case where the physically handicapped person operation is detected;

OFF condition: In the case where anyone of the above-mentioned items (1) to (3) is satisfied.

The warning information detecting means 37 calculates an overall evaluation value of an emergency degree for each of the cars based upon FIG. 7 and the below-mentioned formula:

overall evaluation value=$\alpha\times$evaluation value of undetected time information+$\beta\times$evaluation value of car load information+$\gamma\times$evaluation value of disaster operation information+$\delta\times$evaluation value of physically handicapped person operation information.

FIG. 8 is an explanatory diagram for indicating one example of detection information for the respective cars 1 to 3. FIG. 9 is an explanatory diagram for indicating evaluation values of the respective items corresponding to the detection information of FIG. 8. In other words, assuming that the detection information of the cars 1 to 3 of FIG. 1 is given as indicated in FIG. 8, the respective items may be calculated as indicated in FIG. 9.

Assuming that all of evaluation coefficients α, β, γ, and δ are respectively equal to 1, overall evaluation values of the respective elevator machines are calculated as follows:

elevator machine A: overall evaluation value=1×2+1×1+1×1+1×0=4 elevator machine B: overall evaluation value=1×2+1×1+1×1+1×1=5 elevator machine C: overall evaluation value=1×1+1×1+1×1+1×0=3

In this case, since the evaluation coefficients α, β, γ, and δ are used for weighting the respective evaluation items, if there is an item which must be emphasized, then a coefficient may be set to a large value in response to a degree thereof. For instance, when an importance is put on helping a physically handicapped person, the coefficient δ may be set to, for example, 2.

Alternatively, the evaluation value of the elevator load information may be changed in response to an estimated total number of passengers.

Next, a description is made of a method for performing a warning information display. The warning information detecting means 37 creates a warning information display instruction based upon an overall evaluation value of each of the cars, and then, sends the created warning information display instruction to the display control means 20. Upon receipt of the warning information display instruction, as shown in FIG. 2, the display control means 20 displays warning information on the warning information display area 27. A content displayed in the warning information display area 27 is indicated in FIG. 10. In this case, an interphone condition is identical to the content displayed in the channel selection button display area 26 of FIG. 2, and owns another function as the channel selection button. Also, the elevator machine name, the undetected information, the car load information, the disaster operation information, and the physically handicapped person operation information correspond to such information that is employed when the overall evaluation values are calculated.

FIG. 11 is an explanatory diagram for showing an example of display order information of warning information displayed in the warning information display area 27 of FIG. 2. This example is made based upon the above-described calculation example of the overall evaluation values.

In the above-mentioned elevator monitoring system, while the interphone base device 7 and the operation monitoring apparatus 8 can communicate with each other, the operation monitoring apparatus 8 detects presence of such a passenger that cannot perform an interphone communication based upon the communication condition information and the operation condition data. As a result, the operation monitoring apparatus 8 can automatically detect the passengers in the cars 1 to 3 who cannot perform the telephone communications by way of the interphone.

Also, when the disaster operation is carried out for the time duration equal to or longer than the preset time under such a condition that the passengers are in the cars 1 to 3, and also the interphone communication is not detected, the operation monitoring apparatus 8 judges that the passengers cannot perform the interphone communication. As a result, the detection precision can be improved.

Further, since the car load information and the disaster operation information are contained in the operation condition data, the operation monitoring apparatus 8 can effectively judge whether or not the passengers are present in the cars 1 to 3 and whether the disaster operation is carried out.

Further, when the operation monitoring apparatus 8 detects that the passengers cannot perform the interphone communication, the operation monitoring apparatus 8 executes the calculations for evaluating the emergency degrees with respect to each of these cars 1 to 3 and displays the calculation results on the monitor 19. As result, the efficiency of the rescuing operation can be improved.

Also, while the manager monitors the operation conditions of the elevators in front of the operation monitoring apparatus 8, the manager can perform the interphone communications with the passengers within the desirable cars 1 to 3. As a result, even when the emergent event occurs, the manager can quickly perform the interphone communications with the passengers in the cars 1 to 3.

The invention claimed is:

1. An elevator monitoring system, comprising:

an interphone base device telephone-communicating with a plurality of interphone terminal devices; and an operation monitoring apparatus that receives operation condition data from a group supervisory control device which controls operations of a plurality of elevators and displays operation conditions of the elevators on a monitor, wherein:

the interphone base device and the operation monitoring apparatus telephone-communicate with each other; and the operation monitoring apparatus detects that a passenger within a car of at least one of the elevators cannot perform an interphone communication based upon the operation condition data and information of communication conditions with respect to the interphone terminal devices, which are received from the interphone base device.

2. The elevator monitoring system according to claim 1, wherein when a disaster operation is carried out for a time duration equal to or longer than a preset time under such a condition that passengers are in the cars and the interphone communication is not detected, the operation monitoring apparatus judges that the passengers cannot perform the interphone communication.

3. The elevator monitoring system according to claim 1, wherein car load information and disaster operation information are contained in the operation condition data.

4. An elevator monitoring system, comprising:

an interphone base device telephone-communicating with a plurality of interphone terminal devices; and an operation monitoring apparatus that receives operation condition data from a group supervisory control device which controls operations of a plurality of elevators so as to display operation conditions of the elevators on a monitor, wherein:

the interphone base device and the operation monitoring apparatus telephone-communicate with each other;

the operation monitoring apparatus detects that a passenger within a car of at least one of the elevators cannot perform an interphone communication based upon the operation condition data and information of communication conditions with respect to the interphone terminal devices, which are received from the interphone base device; and when the operation monitoring apparatus detects that the passengers cannot perform the interphone communication, the operation monitoring apparatus executes a calculation for evaluating degree of emergency with respect to each of the cars and displays a result of the calculation on the monitor.

5. The elevator monitoring system according to claim 4, wherein the calculation for evaluating the degree of emergency corresponds to a calculation for obtaining a total value of evaluation values for a plurality of evaluation items.

6. The elevator monitoring system according to claim 4, wherein the calculation for evaluating the degree of emergency corresponds to a calculation for obtaining a total value of products between evaluation values for a plurality of evaluation items and evaluation coefficients used to weigh each of the evaluation items.

7. The elevator monitoring system according to claim 6, wherein the operation condition data contains physically handicapped person operation information, and the evaluation items contain an evaluation of the physically handicapped person operation information.

* * * * *